United States Patent [19]

Standring

[11] Patent Number: 4,807,818

[45] Date of Patent: Feb. 28, 1989

[54] MILL FOR GRINDING GRANULAR MATERIAL

[75] Inventor: Peter M. Standring, Nottingham, England

[73] Assignee: National Research Development Corporation, London, England

[21] Appl. No.: 930,370

[22] PCT Filed: Feb. 21, 1986

[86] PCT No.: PCT/GB86/00086

§ 371 Date: Oct. 27, 1986

§ 102(e) Date: Oct. 27, 1986

[87] PCT Pub. No.: WO86/04835

PCT Pub. Date: Aug. 28, 1986

[30] Foreign Application Priority Data

Feb. 26, 1985 [GB] United Kingdom ..... 8504901

[51] Int. Cl.[4] ..... B02L 7/12

[52] U.S. Cl. ..... 241/198 R; 241/117; 241/257 R

[58] Field of Search ..... 241/30, 117, 118, 120, 241/123, 126, 198 R, 199, 199.9, 220, 257, 258, 301

[56] References Cited

U.S. PATENT DOCUMENTS 4,067,503 1/1978 Broman ..... 241/117

FOREIGN PATENT DOCUMENTS 932472 9/1955 Fed. Rep. of Germany .

*Primary Examiner*—Timothy V. Eley

*Attorney, Agent, or Firm*—Cushman, Darby & Cushman

[57] ABSTRACT

A conical grinding member (2) is caused to move over a grinding surface (1) and material deposited on the surface is ground by a crushing and shearing action. The mill finds particular application in the grinding of grain.

1 Claim, 2 Drawing Sheets

MILL FOR GRINDING GRANULAR MATERIAL

FIELD OF THE INVENTION

This invention relates to a mill for grinding granular material, for example grain and to a method of grinding granular material.

Conventional grain mills utilise rollers to crush the grain. This requires a relatively heavy construction and a high consumption of power to drive the rollers, and such mills are not readily scaled down for small-scale use. An object of the invention is to provide a mill which can be used in a wide range of sizes, and which is not costly in power to operate.

According to the present invention there is provided a mill for grinding granular materials comprising a grinding surface, a generally conical grinding member, a mounting for the grinding member arranged to permit the grinding member to be rolled around the grinding surface.

The present invention also provides a method of grinding granular material in which the granular material to be ground is introduced between a conical grinding member and a grinding surface and in which the material in being ground is subjected to both a crushing and a shearing action.

Although the grinding surface may be fixed, it is preferable to mount the surface for rotation about an axis upon which lies the vertex of the grinding member, the surface being rotated at such a speed relative to the movement of the grinding member that the desired degree of shear between the grinding member and the surface is achieved. The grinding surface and the grinding member are preferably driven by a single motor, via a common drive shaft, the speed of the grinding surface relative to the shaft being variable, for example by a drive belt and opposed tapering or stepped pulleys.

The grinding member may include a passage therethrough opening at at least one aperture through the wall of the member adjacent to the vertex, whereby granular material may be fed down through the interior of the grinding member.

It has been found that a mill in accordance with the invention grinds grain efficiently with a low requirement of effort in moving the grinding member, thus rendering the mill suitable for manual operation.

BRIEF DESCRIPTION OF THE DRAWINGS

Reference is made to the drawings, in which.

DESCRIPTION OF THE PREFERRED EMBODIMENT

Figure 1:
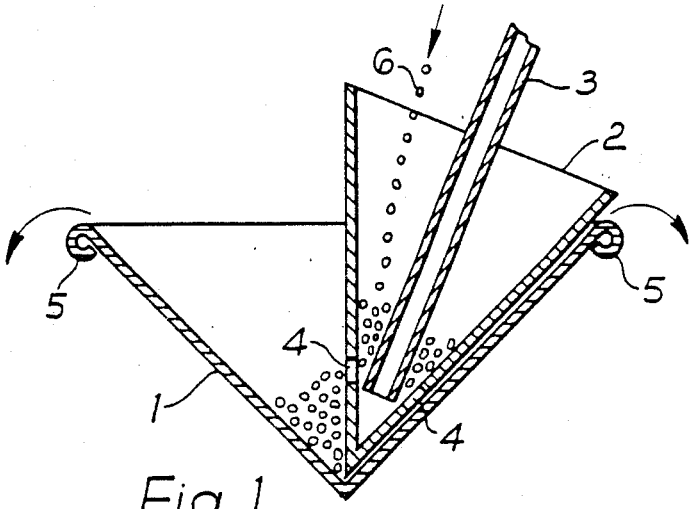
FIG. 1 is a schematic sectional view through a mill therethrough in accordance with one embodiment of the invention to illustrate the principle of operation.

The operating principle of the mill will now be described with reference to FIGS. 1, 2 and 3 which illustrate the theory of operation.

The mill comprises a conical vessel 1 mounted with the vertex of the cone downwardly, and a conical grinding member 2, having a smaller angle opening than the conical vessel 1 is mounted so as to be able to be rolled around the inner surface of the vessel 1 whilst maintaining contact as shown between the vessel walls and the conical grinding member 2. The grinding member 2 is carried by a shaft 3 which may suitably be freely mounted at its upper end in an eccentric rotatable relative to a support. Driving force for the grinding member may be provided manually via a handle, peddle or treadle but for many applications a motor drive will be used.

The axis of the conical vessel 1 may be fixed or may be rotated either in the same direction as the member 2 or the opposite direction. This rotation assists in the movement of the granular material 6 towards the rim 5 and spreads the material 6 over a larger grinding surface.

The grinding member 2 is hollow and preferably has a number of outlets 4 adjacent to the vertex so that granular material 6 such as grain may be fed down through the grinding member, passing through the outlets 4 into the conical vessel 1 for grinding.

The combination of crushing and shearing experienced by the granular material during rotation or oscillation of the grinding member has been found to be effective in reducing the granules to powder form with a major mechanical advantage. It has also been found that the powder tends to move upwardly in the conical vessel 1, to be discharged over the rim 5 thereof.

Figure 2:
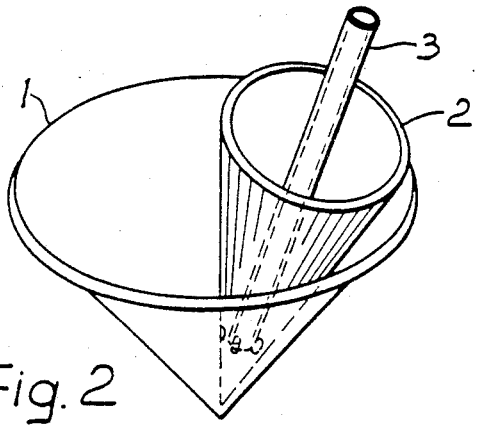
FIG. 2 is a perspective view of the mill shown in FIG. 1.
Figure 3:
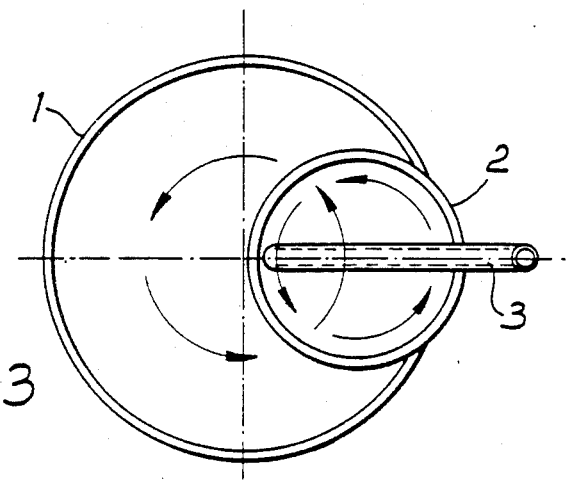
FIG. 3 is a top plan view of the mill shown in FIGS. 1 and 2.

In the mill described in FIGS. 1, 2 and 3 the cone is shown as having a small apex angle and the sides of the conical vessel are shown as fairly steep. In most practical embodiments however the cone apex angle will normally be greater and the sides of the conical vessel will be less steep thus allowing the ground material to move more easily towards the rim 5.

The cone apex angle and the steepness of the sides of the conical vessel may be varied to suit the material being ground. Also the speed of rotation or oscillation of the conical grinding member 2 and the vessel 1 may be varied to suit the particular material to be ground and the required size of the ground material. In general, the higher the speed of rotation of the conical member round the conical vessel the faster the material will be ground. The position of the outlets 4, their number and size and shape is also important in determining the size of the ground material. The size of the outlets must be selected to be large enough to allow free passage of the material 6. Thus, for grain or maize they need to be fairly large but for powdered materials they can be smaller. The parts 1 and 2 may be of steel or other suitable material.

Figure 4:
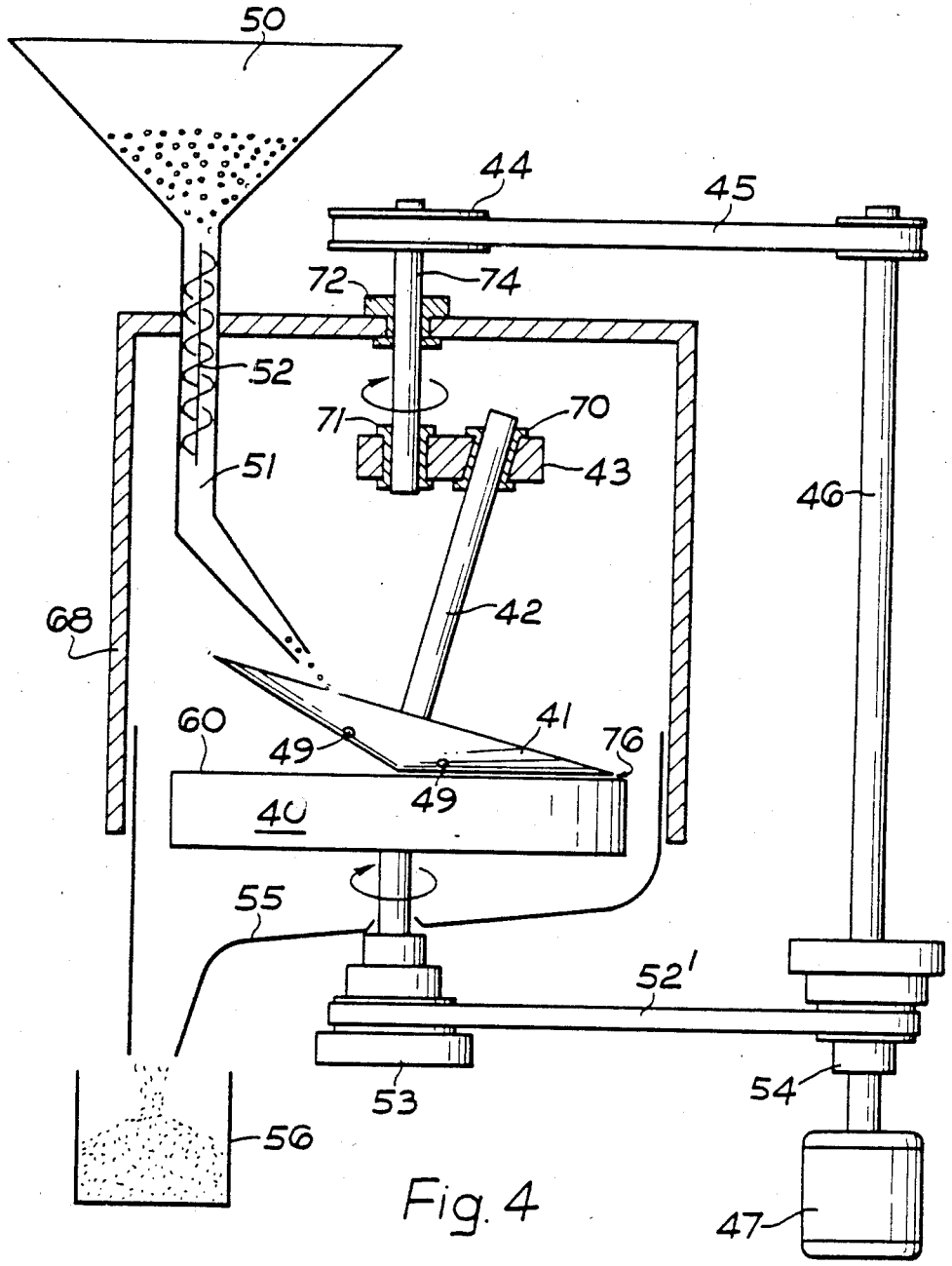
FIG. 4 is an elevation of a practical mill according to another embodiment of the invention.

FIG. 4 shows schematically an alternative, preferred, embodiment, in which a flat grinding surface, in the form of a rotatable turntable 40, is used. A conical grinding member 41 is mounted on a shaft 42 which is engaged at the upper end thereof in freely rotatable manner by a crank 43 driven via a pulley 44 and drive belt 45 from a main drive shaft 46, turned by an electric motor 47. The crank 43 is supported in a support frame 68.

Thrust bearings 70, 71 and 72 are provided as shown, bearing 72 being adjustable to adjust the height of shaft 74 above the grinding surface 60 to allow adjustment of the clearance 76 between the conical grinding member 41 and surface 60.

The motor 47 may be replaced by a suitable manually operable means such as a treadle or bicycle gear drive for use in areas where electricity is not available. The envisaged use in such areas would normally be for grinding grain or maize.

The grinding member 41 rests on or is supported a set clearance distance above the turntable 40 and its axis can be caused to precess relative to the turntable by rotating the crank 43. The grinding member is hollow and is provided with holes 49 therethrough adjacent to the apex thereof, through which grain or other material to be ground, fed to the interior of the member 41 from a hopper 50 via a chute 51, can pass on to the surface of the turntable 40. The interior hollow of the grinding member 41 is so shaped as to prevent grain escaping outwardly over the rim thereof. The chute 51 may be provided with an Archimedes screw 52 driven from the main drive belt 45 by a further belt and pulley arrangement (not shown) to control the feed of the material relative to the speed of rotation of the members 40 and 41.

In order to control the amount of shear present between the grinding member 41 and the turntable 40, the turntable can be caused to rotate by a drive belt 52 extending over opposed stepped pulleys 53 and 54 on the turntable 40 and the drive shaft 46 respectively. The stepped pulleys permit the speed and direction of the turntable relative to the grinding member, and hence the degree of shear present between the surfaces, to be varied to suit different types of material being ground, and will be unnecessary in a mill intended to grinding only one type of material.

A collecting pan 55 beneath and surrounding the turntable collects the ground material, for example flour, and deposits it in a suitable container 56. Other collecting arrangements may be used to suit different circumstances.

The holes 49 may be varied in both size number and in distance from the apex of the cone to suit the material being ground.

The grinding surface 60 on turntable 40 need not be flat but could be slightly concave. It could have on it a series of serrations either radial or concentric. These may be useful in imposing a greater crushing force on the material when the material "lifts" over the serration. The serrations may alternately be on the cone surface 41 or on both cone and turntable surface 60.

If it is required that the material when crushed be under a certain size level then the crushed material may be sieved and then the oversize material can be fed back into the mill for re-grinding.

The lowest generator of grinding member 41 does not have to be parallel to the surface 60 of the turntable 40. The apex of the cone may be slightly further from the surface 60 than the rim of the cone, creating a wedge shape. Material in the centre of the turntable 40 is therefore crushed down to a larger size and as the material moves outwardly towards the rim of turntable 40 it is progressively crushed to a smaller size. This is advantageous since it spreads the girnding over the whole of the cone surface and the surface 60 rather than concentrating the main part of the grinding operation within a central area.

The outlet holes 4, 49 may be replaced by or supplemented with a hole in the centre of the apex of the cone and for certain material this may be sufficient. The advantage of controlling the amount of material by selection of the distance of the holes 49 from the centre is not achievable if a single centre hole is used but the mill will function and such a design may be more economical to produce.

I claim:

1. A mill for grinding granular material comprising:

a grinding surface;

a generally conical grinding member having a hollow therein and an apex;

a mounting arrangement for supporting the grinding member in such a manner that the grinding member can be precessed around the grinding surface, the mounting arrangement including feed means, having one or more holes through a peripheral conical surface thereof for introducing the granular material into the hollow of the grinding member to be fed to the grinding surface as the grinding member is precessed around the grinding surface.

* * * * *